United States Patent [19]

Dubois et al.

[11] 4,389,122

[45] Jun. 21, 1983

[54] CLOCK WITH ELECTRIC OSCILLATOR-CONTROLLED MOTOR

[75] Inventors: Gerald Dubois, Le Lieu; Kaspar Kenel, Niederdorf, both of Switzerland

[73] Assignee: Revue Thommen AG, Switzerland

[21] Appl. No.: 228,389

[22] Filed: Jan. 26, 1981

[30] Foreign Application Priority Data

Oct. 16, 1980 [DE] Fed. Rep. of Germany ... 8027665[U]

[51] Int. Cl.[3] ..... G04F 8/00; G04F 10/00

[52] U.S. Cl. ..... 368/110; 368/112; 368/80; 368/220

[58] Field of Search ..... 368/78, 80, 102, 106, 368/107, 110, 112, 220, 222, 228, 231

[56] References Cited

U.S. PATENT DOCUMENTS

| | | | |
|---|---|---|---|
| 2,289,038 | 7/1942 | Putnam | 368/80 |
| 2,361,563 | 10/1944 | Pellation | 368/80 |
| 2,783,835 | 3/1957 | Poole | 368/112 |
| 3,030,765 | 4/1962 | Lovercheck | 368/80 |
| 3,045,418 | 7/1962 | Heuer | 368/106 |
| 3,430,434 | 3/1969 | Piguet | 368/106 |
| 3,636,700 | 1/1971 | Stemmler | 368/106 |
| 3,879,930 | 4/1975 | Burki | 368/220 |
| 4,059,954 | 11/1977 | Grosse-Plankermann | 368/110 |

*Primary Examiner*—Bernard Roskoski

*Attorney, Agent, or Firm*—McGlew and Tuttle

[57] ABSTRACT

The clock comprises an electronic part including a quartz oscillator controlling a motor. The motor drives, through a wheelwork, both continually running hands and stoppable hands. By means of a manually operated actuator, the stoppable hands can be operatively connected to, or disconnected from, the motor, or reset to zero. With the motor running, the continually running hands can be set to a desired time by means of a hand setting actuator. The crystal-controlled drive provides for high accuracy and the analog indication of the time and of the clocked intervals make reading convenient and fast.

15 Claims, 8 Drawing Figures

CLOCK WITH ELECTRIC OSCILLATOR-CONTROLLED MOTOR

FIELD AND BACKGROUND OF THE INVENTION

The present invention relates to clocks in general and, in particular, to a new and useful clock having a plurality of hands or dials to show increments of time which are connected to a wheelwork or gears that are driven by an electric motor which, in turn, is driven by an electric oscillator.

Clocks comprising a quartz oscillator and a stepping motor, which is connected to the oscillator and drives hands through a transmission to continually indicate the time, are known. Instead of the hands, or in addition thereto, a digital time indication may be provided, and a stop mechanism with a hand-operated actuating member, to start and stop and digitally indicate time intervals may also be included.

Experience has shown that in certain applications, it is disadvantageous to indicate elapsed time intervals by a digital display. An example of this is with the dashboard clock of an airplane, where the pilot frequently needs to note the time interval at a glance.

SUMMARY OF THE INVENTION

The present invention is directed to an electrically driven clock in which time intervals which are determined by starting and stopping a mechanism of the clock need not be read digitally.

Accordingly, an object of the present invention is to provide a clock comprising an electric oscillator, an electric motor connected to the electric oscillator for the output of a timed movement, wheelwork means connected to and driven by the electric motor, and a plurality of hands connected to the wheelwork means for movement to indicate, by their respective positions, increments of time. At least one of the hands can be stopped and restarted by a manually operable actuator which is connected to the at least one hand and the wheelwork means through coupling means. A mechanism is also provided for resetting the position of the at least one hand.

A further object of the invention is to provide such a clock which is simple in design, rugged in construction and economical to manufacture.

The terms, hands for continual time indication, or continually running hands, are referred to throughout the specification and claims. It should be noted that these terms are employed to distinguish these hands from the stoppable hands, and that the motor, which operates stepwise, drives the continually running hands stepwise also. Further, the continually running hands are disengageable from the motor, for setting.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
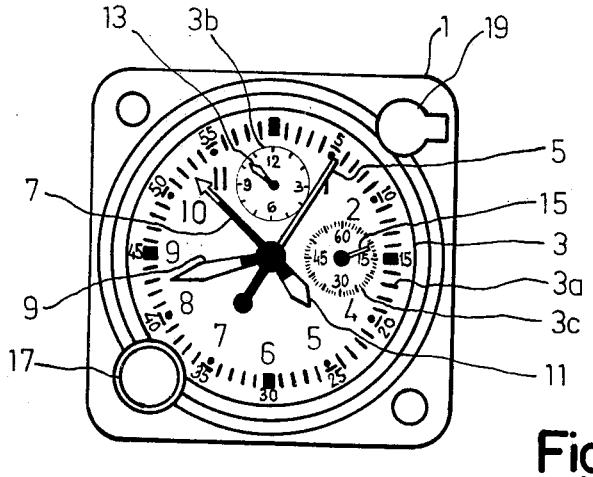
FIG. 1 is a front elevational view of a clock, constructed in accordance with the present invention.

Referring to the drawings in particular, the clock shown in FIG. 1, and intended for mounting on a dashboard of an airplane, comprises, a case 1, carrying a dial plate 3 on its front side which is provided with a main time scale 3*a* extending along its circular circumference. The dial plate is further provided with two smaller circular time scales located eccentrically relative to main scale 3*a*, namely, an hour scale 3*b* and a second scale 3*c*. The clock has four hands mounted for rotation about an axis passing through the center of dial plate 3, namely, a stoppable second hand 5, a stoppable minute hand 7, a continually running minute hand 9 and a continually running hour hand 11. Further provided are a stoppable hour hand 13 and a continually running second hand 15 which are rotatable about the axes passing through the center of scales 3*b* and 3*c*. A manually operated hand setting actuator 17 and a manually operated stop actuator 19 project from the front side of case 1.

Figure 2:
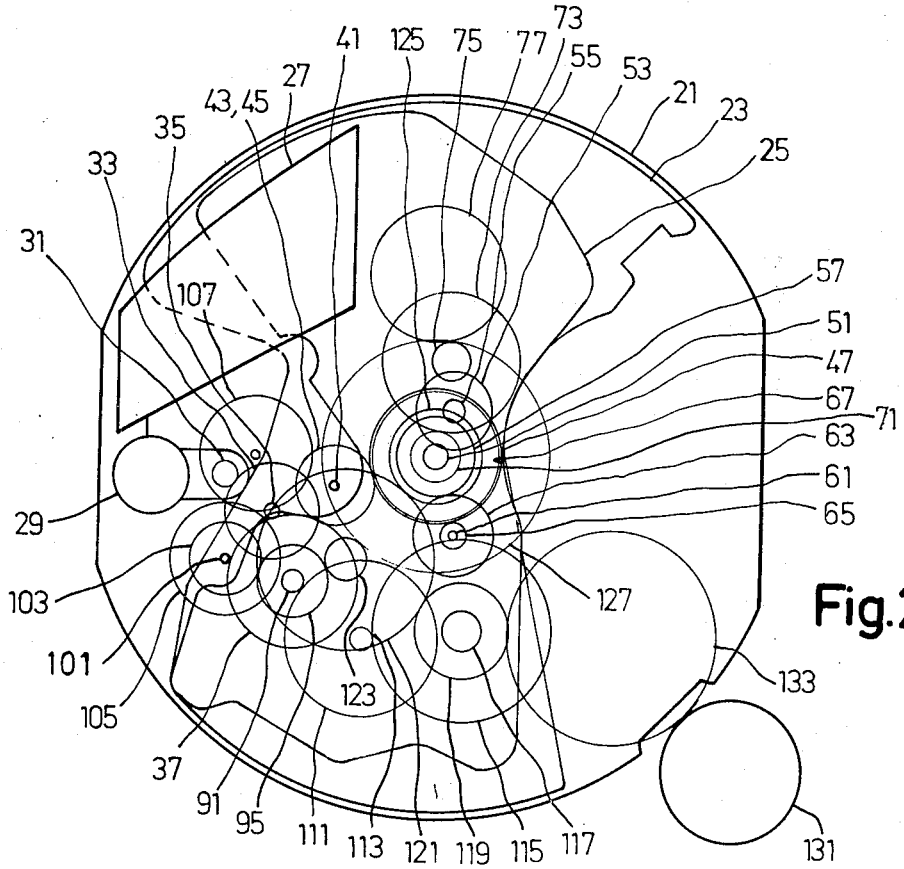
FIG. 2 is a diagrammatical bottom view of the wheelwork, i.e., viewed from the side opposite the dial face.

In FIG. 2, a main mounting plate 21 is shown, to which two smaller plates 23 and 25 are secured by means of columns. Further indicated in FIG. 2 is an electronic part 27 accommodated in case 1 and containing operating means for producing periodic pulses, as will be explained hereinafter. The frequency of the pulses available at the output of the electronic part is one Hz, or an integral multiple thereof, for example, 4 or 5 Hz. The output of electronic part 27 is connected to a stepping motor 29 which is secured to plate 21.

The three plates 21, 23 and 25 are in addition provided with bridges and serve, among other things, as supports for the wheelwork which is indicated in FIG. 2 in a simplified diagrammatic manner and comprises still other parts, such as rockers, in addition to the toothed wheels. The wheelwork includes a pinion 31 connected to the output shaft of motor 29 and meshing with a toothed wheel 33. Wheel 33 and a pinion 35 are carried on a common shaft. Pinion 35 engages a second wheel 37. It will be understood that depending on the length of the steps of the motor, additional toothed wheels may be interposed between the output shaft and the motor and the second wheel 37.

Figure 3:
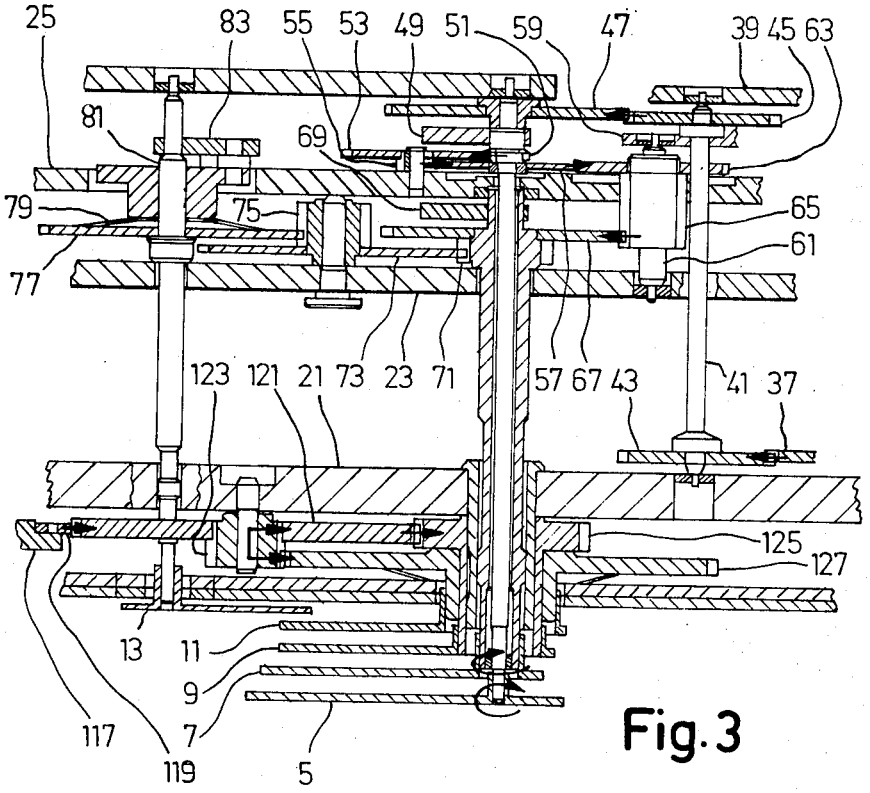
FIG. 3 is a partial sectional view of the wheelwork, the central hands and the stoppable hour hand, with arrows indicating the direction in which the forces or torques are transferred.
Figure 5:
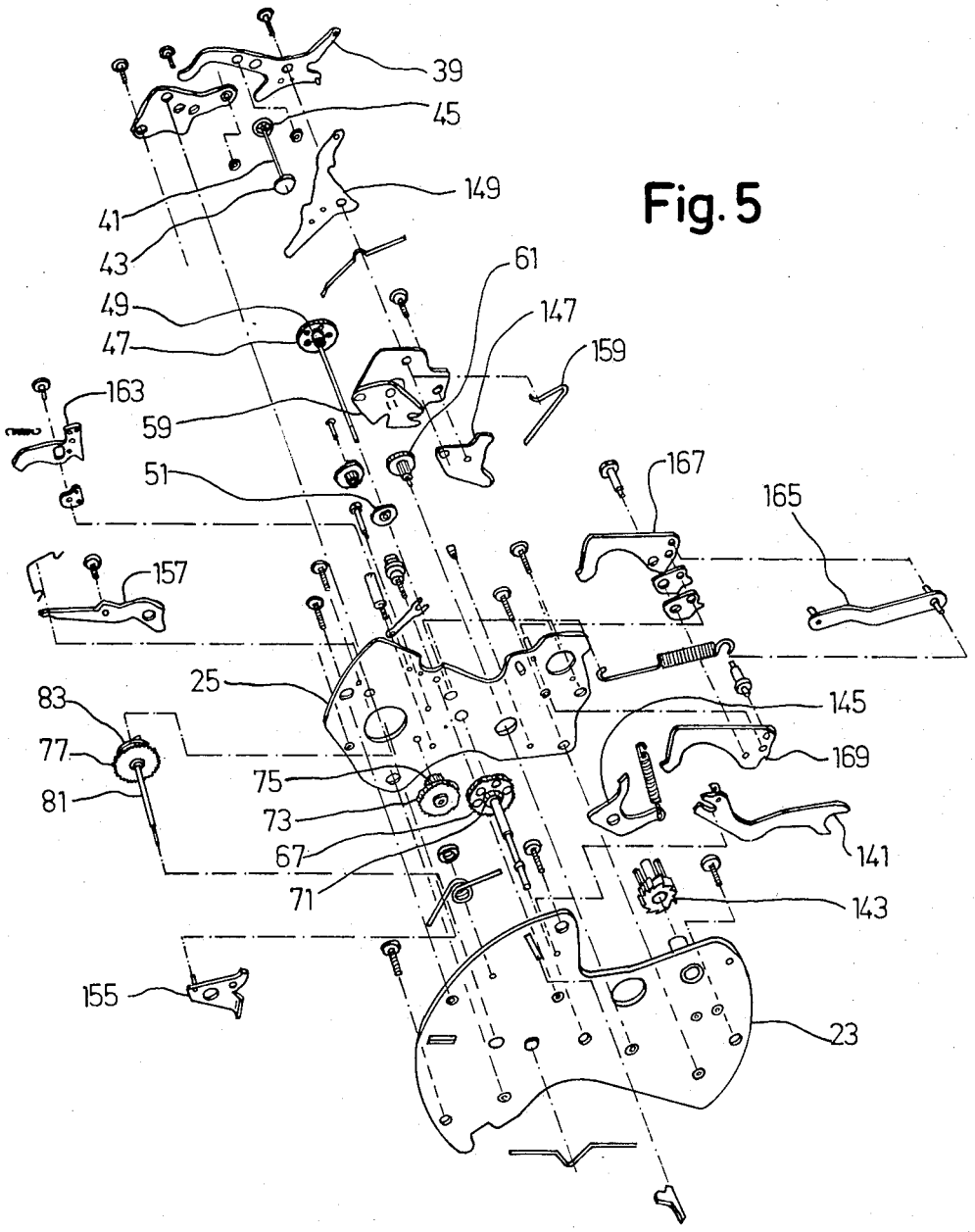
FIG. 5 is an exploded view of the main component parts of the stop mechanism.

Along with plate 21, a coupling lever or rocker 39, shown in FIGS. 3 and 5, supports a gear 41 comprising a shaft and two toothed wheels 43 and 45. With coupling rocker 39 in its position shown in FIG. 3, second wheel 37 meshes with toothed wheel 43 and wheel 45 with wheel 47 which is non-rotatably connected through a shaft to stoppable second hand 5 and to a zero setting heart-shaped member or cam 49.

A pinion 51 is non-rotatably fixed to wheel 47, and meshes with a toothed wheel 53. Wheel 53 is nonrotatably connected to a toothed wheel 55 engaging a toothed wheel 57 which is mounted for free rotation on the common pivot of the four hands 5, 7, 9 and 11. Along with plate 23, a rocker 59 supports a gear 61 comprising two toothed wheels 63 and 65. In the rocker position shown in FIG. 3, wheel 57 meshes with gear wheel 63, and the other wheel 65 of the gear meshes with toothed wheel 67. Wheel 67 is non-rotatably connected through a hollow shaft to stoppable minute hand 7 and to a zero setting heart-shaped cam 69.

A pinion 71 is also non-rotatably connected to toothed wheel 67 and drives a toothed wheel 73 which is non-rotatably connected to a pinion 75. Pinion 75 meshes with a toothed wheel 77 which is connected through a friction clutch 79 to a shaft 81, to a zero setting heart 83, and to the stoppable hour hand 13. The stoppable hands thus are connected for motion by a gear train (51 to 77) with clutch means (61, 79) that permit relative movement between the hands when they are to be reset.

Figure 4:
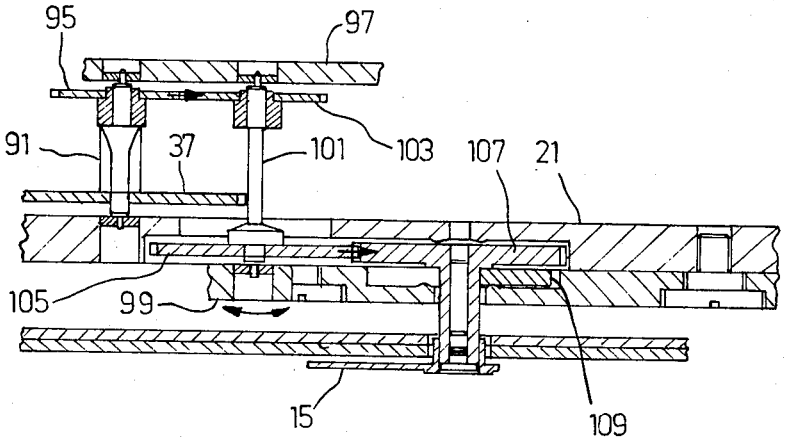
FIG. 4 is a view similar to FIG. 3 of another part of the wheelwork with the continually running second hand.

Second wheel 37 which is driven by the motor, is non-rotatably connected to a pinion 91 and a toothed wheel 95, as shown in FIG. 4. A bridge 97 together with a rocker 99 supports a gear 101 comprising two toothed wheels 103 and 105. With rocker 99 in its position shown in FIG. 4, wheel 95 meshes with wheel 103, and wheel 105 meshes with a wheel 107 which is non-rotatably connected to a zero setting heart 109 and to a continually running second hand 15.

Pinion 91, which is fixed to motor driven second wheel 37, meshes with a toothed wheel 111 which is non-rotatably connected to a pinion 113. Pinion 113 engages a toothed wheel 115 which is connected through a shaft and friction clutch 117 to a toothed wheel 119. It should be noted that small portions of clutch 117 and wheel 119 are visible in FIG. 3 also. Wheel 119 meshes with a toothed wheel 121 which is non-rotatably connected to a pinion 123 and meshed with a toothed wheel 125. Wheel 125 is non-rotatably connected to continually running minute hand 9. Pinion 123 meshes with hour wheel 127 which is non-rotatably connected to continually running hour hand 11. In the following, some elements of the stop mechanism shown in FIG. 5, sometimes termed a chronograph module in the art, are briefly explained.

Stop actuator 19 is both axially displaceable, against the action of a spring, into case 1, and pivotable about its axis. Upon being pushed by hand axially deeper into case 1, it moves an operating lever 141 which, in turn, acts on column wheel 143 having 12 teeth and a rim with six cams distributed over the circumference and spaced from each other. A spring-loaded column wheel jumper 145 engages the tooth rim of volumn wheel 143, whereby preventing uncontrolled rotation thereof. The cam rim is contacted by a coupling member 147 and a lock 149.

Every push and release of stop actuator 19 causes indexing of column wheel 143 by one tooth. Therefore, alternately, cams of the cam rim and spaces between the cams engage the contact portions of coupling member 147 and lock 149. Consequently, these two parts are pivoted in one or the other direction at every step of the column wheel 143. Coupling member 147 is in operative connection with coupling rocker 39 by which gear 41 is pivoted.

With rockers 39 and 59 in their end positions, shown in FIG. 3, motor 29 also drives the three stoppable hands 5, 7 and 13. With rocker 59 in its other end position, the three stoppable hands 5, 7 and 13 are disengaged from the motor and stand still. As long as the stoppable hands are disengaged from the motor, lock 149 engages toothed wheel 47, whereby, this wheel and also stoppable hands 5, 7 and 13 which are connected to each other through toothed wheels and friction clutch 79, are arrented in their motion. Therefore, by sequentially pushing actuator 19 in, the stoppable hands can be alternately started and stopped, and time intervals may thus be measured. Upon a starting push, the hands start running in every instance from the position they have reached at their last stop.

In the following, the elements and movements for resetting the stoppable hands to zero are explained.

With the stoppable hands stopped, second hand 5 is disengaged from the motor already at gear 41, as mentioned above. In order to reset to zero, stop actuator 19 is now temporarily pivoted by hand against the action of the return spring. Thereby, a zero setting rocker 155 is pivoted which is in operative connection with actuator 19 and is acted upon by the mentioned return spring. Rocker 155 acts on a lever 157 which is operatively connected through a spring 159 to rocker 59. As actuator 19 is pivoted, rocker 59 and, thereby, gear 61 are moved to disengage toothed wheels 57 and 63. This uncouples stoppable minute hand 7 from stoppable second hand 5 and consequently from the motor. Since a friction clutch 79 is provided in the train between hour hand 13 and minute hand 7, the three stoppable hands 5, 7 and 13 may be turned and set by hand independently of each other during a zero setting operation.

Further, a pin on rocker 155 is operatively connected to a spring-loaded hour hammer 163. Upon pivoting actuator 19, hour hammer 163 butts against heart 83 which is non-rotatably connected to stoppable hour hand 13. Hammer 163 transfers its pivotal motion through a hammer lever 165 to a second hammer 167 and to a minute hammer 169 connected thereto. Upon pivoting actuator 19, second hammer 167 butts against heart 49 which is non-rotatably connected to stoppable second hand 5, and minute hammer 169 butts against heart 69 which is non-rotatably connected to stoppable minute hand 7. A pivoting of actuator 19 thus causes resetting of all three stoppable hands 5, 7 and 13 to zero, each through a hammer acting on a heart. If, as mentioned, the hands have been stopped prior to their resetting to zero, they remain stopped in the zero position until they are restarted by pushing actuator 19 in.

The mechanical elements shown in the drawing enable an operator to zero the stoppable hands by pivoting actuator 19 even if they are running, i.e., without a preceding stop. In such an instance, however, the hands remain in their zero position until the operator releases the actuator again. As soon as the actuator returns into its initial position, the stoppable hands instantly resume their run as from their zero position without waiting for a new pushing in step of the actuator 19.

Figure 6:
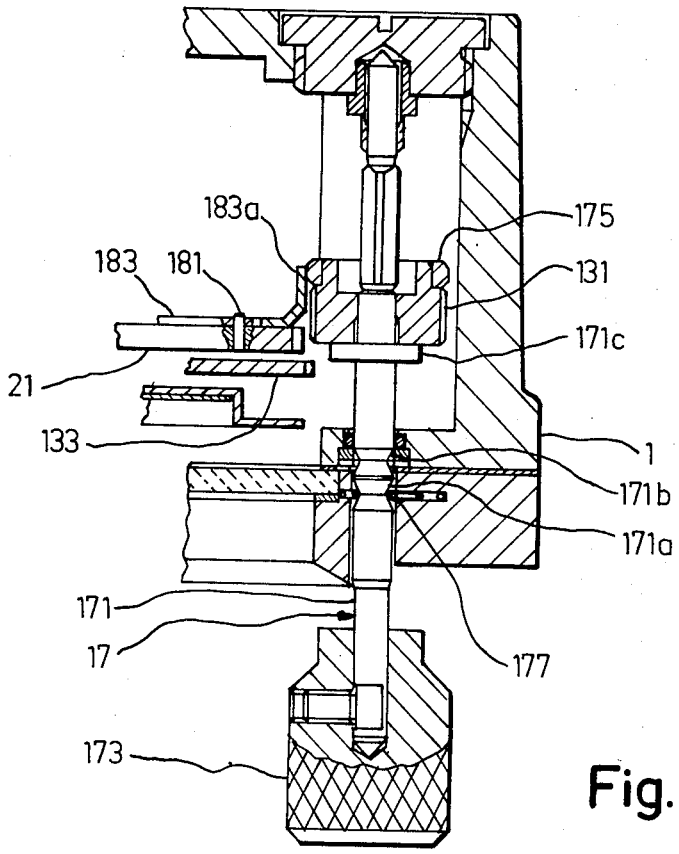
FIG. 6 is a sectional view of the part of the case accommodating the hand setting mechanism.

As shown in FIG. 6, hand setting actuator 17 comprises a shaft 171, a button 173 and a toothed wheel 131 both rigidly secured to shaft 171, and a lever-set ring 175 which is rigidly secured to wheel 131. Actuator 17 is displaceable in the direction of the axis of rotation of the shaft and can thus be selectively brought into one of three positions, namely, into a first or normal position, a second position and a third position. The shaft is provided with two circular grooves 171*a* and 171*b*, and a C-shaped retaining spring 177 is inserted in case 1, which is biased to embrace shaft 171 and hold it in the respective selected position.

In the first position of actuator 17, shown in FIG. 6, retaining spring 177 engages circular groove 171*a*, and in the second position of the actuator, it engages circular groove 171*b*. Shaft 171 is further provided with a collar portion 171*c* serving as a stop. In the second and third selected positions, wheel 131 meshes with a toothed wheel 133. In the first selected position, the toothed wheels 131 and 133 are disengaged from each other. Wheel 133 meshes with the already mentioned toothed wheel 119.

Figure 7:
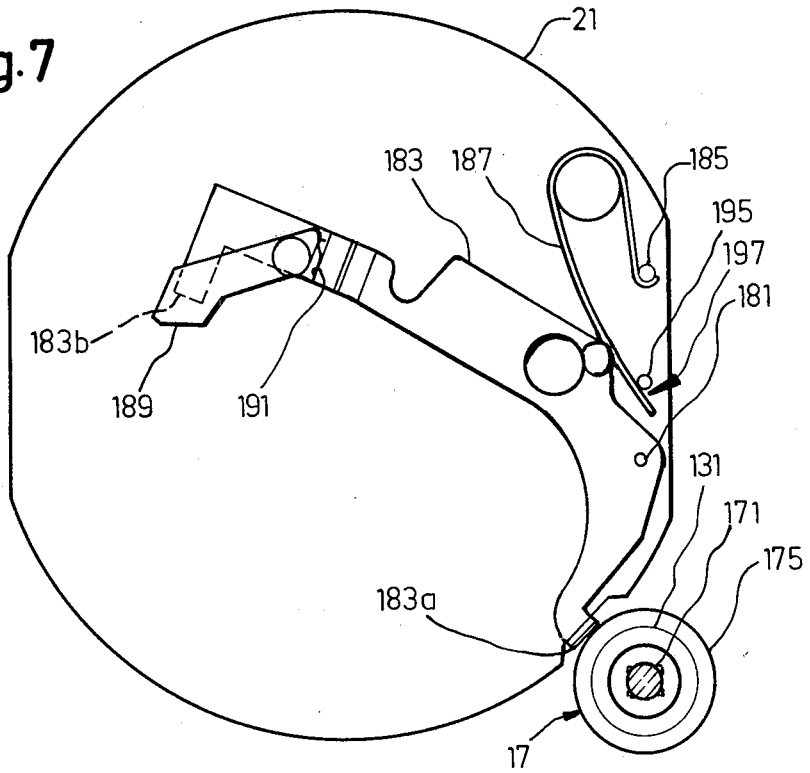
FIG. 7 is a view similar to FIG. 2, showing the elements for zeroing the continually running second hand.
Figure 8:
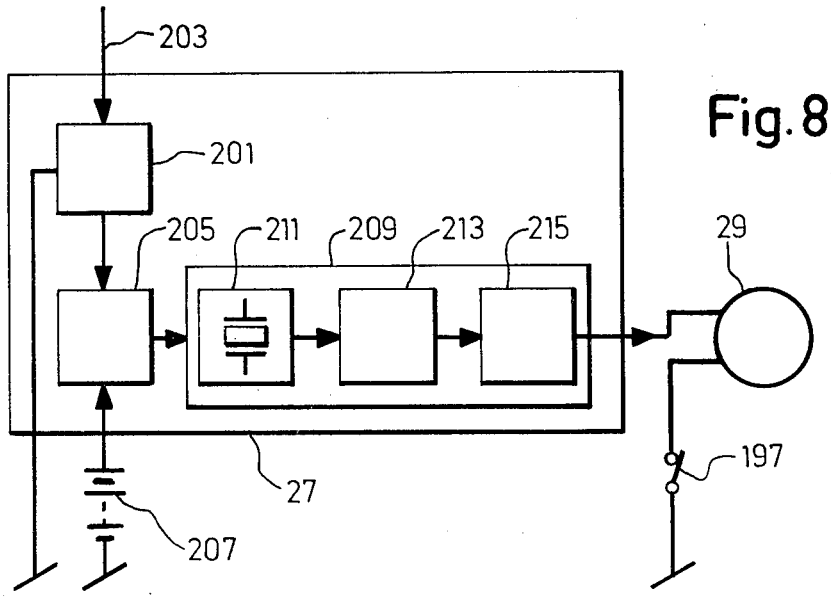
FIG. 8 is a block diagram of the electrical parts of the clock.

Further provided is a zero setting lever 183 which is privoted to plate 21 by means of a pin 181 (see particularly FIG. 7). A spring 187 secured to plate 121 by a holder 185 applies against zero setting lever 183. With actuator 17 in its first or second selected position, the angled end 183*a* of lever 183 applies against lever-set ring 175. Consequently, in the first and second selected position, actuator 17 holds lever 183 in the positions shown in FIGS. 6 and 7, against the force of spring 187 exerted on lever 183. If actuator 17 is pulled out into its third selected position, in which stop 171*c* applies against an inside surface of case 1, ring 175 comes into a position, off angled lever end 183*a*, so that lever 183 is pivoted under the action of spring 187. The other end 183*b* of lever 183 is operatively connected to rocker 99. Adjacent end 183*b*, a pawl 189 is pivoted to lever 183 and is loaded by a spring 191. Pawl 189 is disposed so that it may apply against heart 109.

The connection of spring 187 to plate 21 and thus to case 1 is electrically conducting. Plate 21 further carries a contact 195 which is electrically insulated relative to the plate. Contact 195 and the free end of spring 187, or a contact carried on this end, form an electrical switch 197.

The electronic part 27 comprises a voltage stabilizing circuit 201. The input of this circuit is connected through a connector to a voltage supply system aboard the airplane wherefrom the aircraft is supplied with current, as indicated by arrow 203. One pole of the power supply is applied to the ground to which the voltage stabilizing circuit is also connected through case 1. The circuit is designed to be operable with DC voltages in the range of 5 to 28 volts. The output of voltage stabilizing circuit 201 is connected to an electronic selector switch 205.

A battery 207 accommodated in case 1 or secured to the outside thereof has one of its poles connected to the ground, i.e., case 1, and the other to switch 205. Switch 205 is provided with a voltage monitor and with further electronic components and is designed to be supplied normally from the system on board and only upon a failure of this power supply, from the battery. Battery 207 may be of the dry-cell type to be exchanged from time to time with a fresh battery. A rechargeable battery might also be employed to be charged from the on board system. The DC voltage is applied from switch 205 to a pulse generator 209 comprising a crystal-controlled and trimmable oscillator 211, a frequency divider 213, and a driver stage 215 also serving as a pulse shaper. The output of driver stage 215 is connected to one terminal of stepping motor 29. The other terminal of motor 29 is grounded through already mentioned switch 197 and thus also connected to the voltage source.

With hand setting actuator 17 in its first or normal position, switch 197 is closed and gear 101 is in its position shown in FIG. 4 in which continually running second hand 15 is driven from motor 29. With motor 29 in operation, the three continually running hands 9, 11 and 15 permanently indicate the current time. If it is desired to set hand 9 or hand 11, serving to continually indicate the minute and hour, respectively, without stopping second hand 15, hand setting actuator 17 is pulled axially from its initial first position into its second position, i.e., outwardly.

While pulling actuator 17 outwardly into its second position, toothed wheel 131 which is non-rotatably secured thereto comes to engage toothed wheel 133. If now the operator turns actuator 17 about its axis, this rotation is transmitted through wheel 131 and wheel 133 to toothed wheel 119. Since wheel 119 is connected through friction clutch 117 to wheel 115 which is driven from the motor, wheel 119 can perform a rotary motion relative to wheel 115. The rotation of wheel 119 is then further transferred to the two hands 9 and 11, so that they can be set. In the meantime, second hand 15 is still driven by the motor. Therefore, in the second selected position of hand setting actuator 17, minute hand 9 and hour hand 11 may be set without stopping second hand 15. This possibility of setting the minute and hour hands 9 and 11 is advantageous particularly if the airplane carrying the dashboard clock passes into another time region and the clock is to be adjusted by a full hour or multiple thereof.

If actuator 17 is pulled outwardly from its second into its third selected position, i.e., until stop 171*c* butts against the case, zero setting lever 183 is pivoted, as already mentioned. Lever 183 then moves rocker 99 and gear 101 in a manner such that the wheels 105 and 107 disengage and second hand 15 is uncoupled from the motor. Further, the displacement of actuator 17 into its third position causes pawl 189, which is retained by lever 183, to apply against heart 109 and thereby set hand 15 to zero. Hand 15 then remains in this position until actuator 17 is returned again into its second or first position. With actuator 17 in its third position, current supplied to motor 29 is interrupted by switch 197 and the motor is stopped. In the same way as in the second selected position, the minute and hour hands can be set by turning actuator 17, and minute hand 9, hour hand 11, and second hand 15 may be set to any full minute.

As long as switch 197 is open and the current supply to motor 29 is interrupted, electronic part 27 consumes but little energy. Therefore, if it is desired to minimize the current consumption for a long period of disuse of the clock, actuator 17 may be brought for this period into its third selective position in which switch 197 is open. It should be noted in this connection that instead of switch 197, a switch might be employed interrupting in open state the supply to electronic part 27 so that no current at all would be drawn from the battery during that period. Further, this switch might be connected between the driver stage and the motor. In addition, if desired or necessary, both contacts of the switch may be insulated relative to ground.

The clock also comprises an electrical scale illuminator which again is supplied either from the airplane supply system or from the battery.

Since the clock is driven by a motor controlled by an electronic oscillator, namely, a quartz oscillator, a high accuracy can be obtained. Disregarding their setting, the continually running hands as well as the stoppable hands indicate the time or the length of the time intervals between two stops, in analog form, which is a convenient and fast manner of showing the time or the clocked interval, and particularly advantageous in an application as a dashboard clock in airplanes.

During the stopping, stoppable minute hand 7 and stoppable hour hand 13 are not disengaged from stoppable second hand 5 and stoppable second hand 15 is braked. Therefore, if the clock is stopped and then restarted without a preceding resetting, none of the three stoppable hands does move between the instants of stopping and restarting, not even with the clock subjected to some shaking. This ensures a great accuracy of measurements in which a number of intervals is sequentially clocked and added, which again is useful in applications as a dashboard clock in airplanes.

The means for setting the hands 9, 11 and 15 for continual time indication are of such design that the minute and hour hands can be set without, at the same time, disturbing the clocking of a time interval which might be measured simultaneously. If the above-mentioned switch interrupting the current supply to the motor in the third selected position of actuator 17 is omitted, even second hand 15 may be reset to zero, without obstructing a simultaneous measuring of the time interval by means of the stop mechanism.

If a plurality of clocks is mounted in the same airplane, a common electronic part accommodated in a master clock, for example, may be provided for a plurality of clocks. The electronic part may then be connected to a plurality of clocks in which no batteries or electronic parts are necessary.

It will be understood that the clock can serve not only as a dashboard clock in airplanes, but may easily be adapted to other purposes as well.

The above-described mechanism is known in the art as a double-function chronograph in which the resetting to zero is performed by another actuation of the actuator serving the purpose of starting and stopping. Therefore, after a stop, the chronograph may be restarted without previously resetting to zero, and thus sequentially clocked intervals may be added to each other.

With small changes, the stop mechanism may also be designed as a so-called three-function chronograph in which the same kind of actuation, namely, a consecutive pushing down is provided for starting, stopping and zeroing.

It would also be possible, however, to provide two or three separate actuators for starting, stopping and resetting. The number of stoppable and continually running hands may vary as needed. For example, the stoppable hour hand and/or the continually running second hand may be omitted.

While a specific embodiment of the invention has been shown and described in detail to illustrate the application of the principles of the invention, it will be understood that the invention may be embodied otherwise without departing from such principles.

What is claimed is:

1. A clock comprising: an electric motor which is controllable by an electric oscillator for the output of a timed movement; wheelwork means connected to and driven by said electric motor; a plurality of hands connected to said wheelwork means for movement to indicate by their respective positions, increments of time; a manually operable actuator connected to said wheelwork means; at least one of said plurality of hands comprising at least one stoppable hand for showing by its position an elapsed time; said wheelwork means including coupling means engageable and disengageable by said actuator to and from said motor and said at least one stoppable hand for respectively starting and stopping movement of said at least one stoppable hand; and mechanical resetting means connected to said actuator and engageable with said stoppable hand to reset the position of said stoppable hand to an initial position; said actuator being so cooperable with said coupling means and said resetting means that said at least one stoppable hand can be started, stopped and reset by purely mechanical force transmitted to said stoppable hand exclusively from said actuator by way of said coupling means, said coupling means comprising a lever connected to and movable by said actuator, a shaft rotatably mounted on said lever, a first toothed wheel connected to said shaft, a second toothed wheel connected to said at least one stoppable hand, said shaft connected to said motor for rotation; said actuator movable to engage said first toothed wheel with said second toothed wheel to start movement of said stoppable hand and to disengage said first toothed wheel from said second toothed wheel to stop movement of said stoppable hand.

2. A clock, according to claim 1, comprising a case provided with means for mounting said case on an airplane instrument panel, said actuator projecting from a front side of said case.

3. A clock, according to claim 1, wherein said shaft is journalled only at one end in said lever and is journalled at another end in a rigidly mounted plate.

4. A clock, according to claim 3, wherein said at least one stoppable hand is torsionally rigidly connected to a heart-shaped reseting cam and is associated with a hammer which is operable by said actuator and cooperable with said cam to effect resetting of said stoppable hand.

5. A clock comprising: an electric motor which is controllable by an electric oscillator for the output of a timed movement; wheelwork means connected to and driven by said electric motor; a plurality of hands connected to said wheelwork means for movement to indicate by their respective positions, increments of time; a manually operable actuator connected to said wheelwork means; at least one of said plurality of hands comprising at least one stoppable hand for showing by its position an elapsed time; said wheelwork means including coupling means engageable and disengagable by said actuator to and from said motor and said at least one stoppable hand for respectively starting and stopping movement of said at least one stoppable hand; and mechanical resetting means connected to said actuator and engageable with said stoppable hand to reset the position of said stoppable hand to an initial position; said actuator being so cooperable with said coupling means and said resetting means that said at least one stoppable hand can be started, stopped and reset by purely mechanical force transmitted to said stoppable hand exclusively from said actuator by way of said stoppable means; said plurality of hands including at least two additional stoppable hands; said wheelwork means including a gear train meshed between said at least one and said additional stoppable hands, said gear train remaining meshed during stopping of said stoppable hands and including clutch means for permitting relative movement between said at least one and said additional stoppable hands when said resetting means resets the position of said at least one stoppable hand; said gear train including at least one gear connected to a shaft and at least one pair of other gears; said clutch means comprising a friction clutch between said one gear and said shaft and a rocker connected to one of said pair of other gears movable to disengage said pair of other gears from each other, said rocket connected to said resetting means.

6. A clock, according to claim 5, comprising a case provided with means for mounting said case on an airplane instrument panel, said actuator projecting from a front side of said case.

7. A clock comprising: an electric motor which is controllable by an electric oscillator for the output of a timed movement; wheelwork means connected to and driven by said electric motor; a plurality of hands connected to said wheelwork means for movement to indicate by their respective positions, increments of time; a manually operable actuator connected to said wheelwork means; at least one of said pluarlity of hands comprising at least one stoppable hand for showing by its position an elapsed time; said wheelwork means including coupling means engageable and disengageable by said actuator to and from said motor and said at least one stoppable hand for respectively starting and stopping movement of said at least one stoppable hand; and mechanical resetting means connected to said actuator and engageable with said stoppable hand to reset the position of said stoppable hand to an initial position; said actuator being so cooperable with said coupling means and said resetting means that said at least one stoppable hand can be started, stopped and reset by purely mechanical force transmitted to said stoppable hand exclusively from said actuator by way of said stoppable means; said at least one stoppable hand comprising a stoppable second hand; said plurality of hands including a stoppable minute hand engageable with said coupling means, a running minute hand engaged through said wheelwork with said motor for continual motion to indicate the passage of time, and a running hour hand connected to said wheelwork to said motor for continual time indication; said plurality of hands including a stoppable hour hand engageable with said coupling means; said stoppable second and minute hands and said running minute and hour hands being mounted about a common axis and said stoppable hour hand is mounted for rotation about a second axis spaced from said first mentioned axis.

8. A clock, according to claim 7, comprising a case provided with means for mounting said case on an airplane instrument panel, said actuator projecting from a front side of said case.

9. A clock, according to claim 7, wherein said plurality of hands includes a running second hand connected through said wheelwork to said motor for continually indicating the passage of time.

10. A clock, according to claim 9, wherein said running minute and hour hands and said stoppable second and minute hands are mounted about a common axis and said running second hand is mounted about a second axis spaced from said first-mentioned axis.

11. A clock, according to claim 9, including a hand setting actuator for setting the position of said running hands, said hand setting actuator being rotatably and axially movable, said wheelwork including uncoupling means connected between said running second hand and said hand setting actuator for disconnecting said running second hand from said motor when said hand setting actuator is moved to set said running hands, and running second hand setting means associated with said running second hand actuatable by movement of said hand setting actuator to set the positions of said running hands to displace said running second hand into an initial position and maintain said initial position while said hand setting actuator is in its position to move said running hands.

12. A clock, according to claim 11, wherein said hand setting actuator is selectively displaceable into a first, a second and a third position, said hand setting actuator in said first position being disconnected from said running hands, said hand setting actuator in its second position being engaged with said running minute and hour hands for movement thereof with rotation of said hand setting actuator, and said hand setting actuator in its third position being engaged with said running minute and hour hand and with said uncoupling means and said running second hand setting means for moving said running second hand into said initial position and holding said running second hand at said initial position until said hand setting actuator is moved out of its third position.

13. A clock, according to claim 11, including a switch connected to said motor and engageable by said hand setting actuator for turning said motor off when said running second hand is held at said initial position by movement of said hand setting actuator.

14. A clock, according to claim 7, wherein said stoppable second hand and stoppable minute hand are mounted on shafts that are connected by a gear train comprising two gear wheels which form a coupling device controllable by said actuator in such a manner that on operation of said actuator for resetting of said stoppable hands said two gear wheels are uncoupled to separate said stoppable hands from each other.

15. A clock, according to claim 7, wherein said stoppable minute hand and said stoppable hour hand are mounted on shafts which are connected by gear wheels and a friction clutch.

* * * * *

UNITED STATES PATENT OFFICE

CERTIFICATE OF CORRECTION

Patent No. 4,389,122 Dated June 21, 1983

Inventor(s) Dubois et al

It is certified that error appears in the above-identified patent and that said Letters Patent are hereby corrected as shown below:

Claim 1, at Column 8, line 17, after "coupling" insert --and resetting--.

Claim 5, at Column 8, line 62, change "stoppable" to --coupling and resetting--.

Claim 7, at Column 9, line 36, change "stoppable" to --coupling and resetting--.

Signed and Sealed this

*Thirteenth* Day of *December 1983*

[SEAL]

*Attest:*

GERALD J. MOSSINGHOFF

*Attesting Officer*

*Commissioner of Patents and Trademarks*